US010335966B2

(12) United States Patent
Julemont

(10) Patent No.: US 10,335,966 B2
(45) Date of Patent: Jul. 2, 2019

(54) CLIPPERS FOR NOSE AND EAR HAIRS

(71) Applicant: BABYLISS FACO SPRL, Wandre (BE)

(72) Inventor: Pierre Julemont, Soumagne (BE)

( * ) Notice: Subject to any disclaimer, the term of this patent is extended or adjusted under 35 U.S.C. 154(b) by 18 days.

(21) Appl. No.: 15/503,921

(22) PCT Filed: Jul. 17, 2015

(86) PCT No.: PCT/EP2015/066448

§ 371 (c)(1),
(2) Date: Feb. 14, 2017

(87) PCT Pub. No.: WO2016/023706

PCT Pub. Date: Feb. 18, 2016

(65) Prior Publication Data

US 2017/0239825 A1 Aug. 24, 2017

(30) Foreign Application Priority Data

Aug. 14, 2014 (EP) ..... 14180988

(51) Int. Cl.
*B26B 19/14* (2006.01)
*B26B 19/46* (2006.01)

(52) U.S. Cl.
CPC ..... *B26B 19/148* (2013.01); *B26B 19/143* (2013.01); *B26B 19/46* (2013.01)

(58) Field of Classification Search
CPC ... B26B 19/143; B26B 19/148; B26B 19/145; B26B 19/16
See application file for complete search history.

(56) References Cited

U.S. PATENT DOCUMENTS

| | | | | |
|---|---|---|---|---|
| 1,973,631 A | | 9/1934 | Johnson | |
| 2,212,856 A | * | 8/1940 | Dalkowitz | B26B 19/148 30/29.5 |
| 2,331,873 A | | 3/1941 | Thews | |
| 2,987,818 A | | 6/1961 | Rosenstein | |
| 3,284,894 A | | 11/1966 | Ryan | |
| 3,731,379 A | | 5/1973 | Williams | |
| 3,925,888 A | | 12/1975 | Bozsanyi | |
| 3,965,569 A | * | 6/1976 | Bolduc | B26B 19/148 30/29.5 |

(Continued)

FOREIGN PATENT DOCUMENTS

| | | |
|---|---|---|
| EP | 1747858 A2 | 1/2007 |
| EP | 1749622 A2 | 7/2007 |

(Continued)

*Primary Examiner* — Sean M Michalski
*Assistant Examiner* — Fernando Ayala
(74) *Attorney, Agent, or Firm* — Lawrence Cruz, Esq.; Ryan, Mason & Lewis, LLP

(57) ABSTRACT

The present invention relates to motorized clippers for hairs growing in the nose and ear cavities, comprising a shaving head with a moving blade (5) and a stationary blade (6), the stationary blade having slots (7) for penetration of the hairs on the front face (2) and on the side face (3) viewed in the direction of introduction of the shaving head into the cavity to be clipped, and said stationary blade also comprising slots for the penetration of hairs on the rear face (4) allowing cutting also of the hairs during withdrawal of the shaving head from the cavity to be clipped.

18 Claims, 7 Drawing Sheets

(56) References Cited

U.S. PATENT DOCUMENTS

| | | | | |
|---|---|---|---|---|
| 4,521,962 | A * | 6/1985 | Van Natta | B26B 19/148 30/29.5 |
| 4,958,432 | A | 9/1990 | Marshall | |
| 4,980,973 | A * | 1/1991 | Lee | B26B 19/148 30/29.5 |
| 5,123,430 | A * | 6/1992 | Davidovitz | A45D 29/02 132/73.6 |
| 5,979,056 | A | 11/1999 | Andrews | |
| 6,067,714 | A | 5/2000 | Taylor et al. | |
| 6,151,785 | A | 11/2000 | Morris | |
| 6,272,752 | B1 | 8/2001 | Pino | |
| 6,505,403 | B1 | 1/2003 | Andrews | |
| 6,711,822 | B1 * | 3/2004 | Ginns | B26B 19/16 30/206 |
| 6,836,965 | B1 * | 1/2005 | Ross | B26B 19/148 30/29.5 |
| 8,959,775 | B2 | 2/2015 | Yabuuchi et al. | |
| 2004/0068873 | A1 | 4/2004 | Tona | |
| 2005/0005453 | A1 * | 1/2005 | Egeresi | B26B 19/34 30/34.1 |
| 2005/0028369 | A1 * | 2/2005 | Cocchiarella | B26B 19/148 30/29.5 |
| 2005/0198824 | A1 | 9/2005 | White | |
| 2007/0022605 | A1 * | 2/2007 | Morisugi | B26B 19/148 30/43.4 |
| 2011/0010941 | A1 | 1/2011 | Lau | |
| 2011/0016722 | A1 * | 1/2011 | Stark | B26B 19/00 30/45 |
| 2011/0067241 | A1 | 3/2011 | Ogawa et al. | |
| 2011/0072669 | A1 * | 3/2011 | Morisugi | B26B 19/148 30/29.5 |
| 2011/0232096 | A1 * | 9/2011 | Yabuuchi | B26B 19/148 30/29.5 |
| 2015/0251325 | A1 | 9/2015 | Teteak et al. | |

FOREIGN PATENT DOCUMENTS

| | | | |
|---|---|---|---|
| EP | 2298511 | A1 | 3/2011 |
| EP | 2301728 | A1 | 3/2011 |
| FR | 2430829 | B1 | 8/1980 |
| JP | S5940889 | S | 3/1984 |
| JP | H09225158 | A | 2/1997 |
| JP | 2007029382 | A | 8/2007 |
| JP | 4526942 | B2 | 10/2007 |
| WO | 2014088496 | A1 | 6/2014 |

* cited by examiner

CLIPPERS FOR NOSE AND EAR HAIRS

GOALS OF THE INVENTION

This invention relates to a hair nose and ear clipper (NEC) or "tondeuse pour poils de nez et d'oreilles" (TNO) in French.

STATE OF THE ART

The nose and ear hair clippers (NEC) are now well known to users facing the problems of hair growing in the nostrils and the hollow of the ear starting in the middle years.

Different solutions have been proposed to address this problem with one of the first dates back in 1933 when U.S. Pat. No. 1,973,631 presents a solution based on a double superimposed cone with slots and adapted on a pair of scissors. The hair to be cut penetrates into the slot in the two cones and the shear action cuts them.

Although the NEC have experienced many changes since that time, the basic mechanism remained the same.

Document U.S. Pat. No. 2,987,818 (1959) presents a cylindrical and wire form accessory adaptable on a razor. This accessory allows to easily penetrate the nasal and ear cavities.

Document U.S. Pat. No. 3,731,379 (1973) and FR 2 430 829 (1978) present a cutting device exclusively adapted to a NEC function and driven by an electric motor in a stationary head that has the shape of a revolving solid, specially adapted to be introduced in the nasal cavities.

Document U.S. Pat. No. 4,958,432 (1990) discloses a NEC with different types of stationary heads and a plurality of blades arranged as rings.

Other improvements have also been proposed in U.S. Pat. No. 6,272,752 B1 (2001) with special blades or in U.S. Pat. No. 6,067,714 (2000), which features a self-cleaning system by aspiration of water by making the NEC head turn under water.

The improvements of recent years are disclosed in EP 1 747 858 B1 (2006) that offers a particular positioning of the blade on the rotating head and in EP 1 749 622 (2006) which offers a flow path specific to flushing water through the NEC shaving head.

More recently still, EP 2 298 511 B1 (2010) discloses a routing of rinsing liquid around the blades, EP 2 301 728 A1 (2010) discloses a specific arrangement of the blades, US 2011/0010941 A1 discloses a translational movement in the axis of the NEC with blades and either side of a rod in an extension of a handle.

Despite improvements in recent years, all the NEC of the state of the art, outside side blade clippers, usually have a cutting mobile device turning within a stationary rounded cylinder shaped head which can primarily cut hair on the front in the direction of penetration of the cavities where the hairs are located. This type of NEC virtually cuts nothing in the exit direction of the cavities because a penetration of the hair into the slots of the stationary head is provided on the front mainly, and to a lesser extent on the side faces.

GOALS OF THE INVENTION

This invention aims to provide a NEC that offers cutting the hairs by the front face of the shaving head during the penetration direction as well as by its back side during the withdrawal direction from the nasal and ear cavities, by offering a special stationary head geometry equipped with slots to open the round part not only in front and/or side of the cylinder that we call the front and side faces in the penetration direction of the shaving head but also on its rear section.

SUMMARY OF THE INVENTION

This invention discloses a motorized hair clipper for hair growing in the nose and ear cavities comprising a shaving head with a moving blade and a stationary blade, the stationary blade being equipped with slots for the penetration of the hair on the face and on the side face, seen in the shaving head introduction direction in the cavity to be shaved, characterized in that said stationary blade also has slots for the penetration of the hairs on its back to also cut hair during the withdrawal of the shaving head out of the cavity to be shaved.

The preferred invention operating modes include at least one, or any appropriate combination of the following characteristics:

- The stationary head has an overall shape of truncated dual cone;
- The head has a unique spring pushing the blades against the front and back faces of said head;
- The stationary blade has an opening in the center of its front face;
- The stationary blade has an opening in the center of its front face and the drive cylinder has an opening on its side face;
- The stationary blade hair penetration slots make a cutting angle with the radial direction and with respect to the said shaving head rotation axis.
- The stationary blade hair penetration slots extend uninterrupted between the front and the back faces through the side.

LIST OF REFERENCE SYMBOLS

Figure 1:
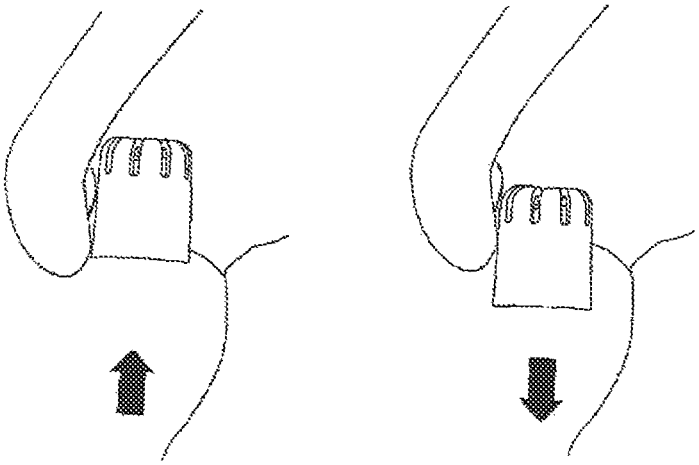
Fig.1 PRIOR ART
FIG. 1 schematically shows the NEC usability according to the state of the art. The absence of hair penetration slots on the back of the stationary head only allows cutting the hairs growing in the shaving head penetration direction in the nasal orifice in this case. With the slots only in the front, the shaving head can capture no hair by withdrawing from the nasal orifice, which reduces its effectiveness. This mode of use therefore favors cutting against the grain which is ineffective if the hair is inclined towards the inside of the cavity.
Figure 2:
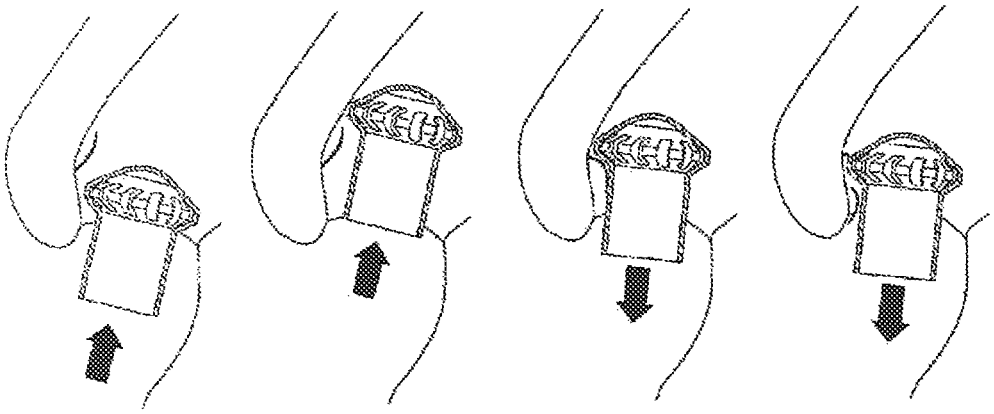
FIG. 2 shows schematically the usability of a NEC according to the invention. The additional presence of hair penetration slots on the back side of the clipper head allows cutting hair in the nasal orifice penetration direction as well as in the withdrawal direction. The shaving head can also capture the hairs by withdrawing from the nasal orifice, by straightening the hairs that go up into the cavity, which increases its effectiveness.
Figure 3:
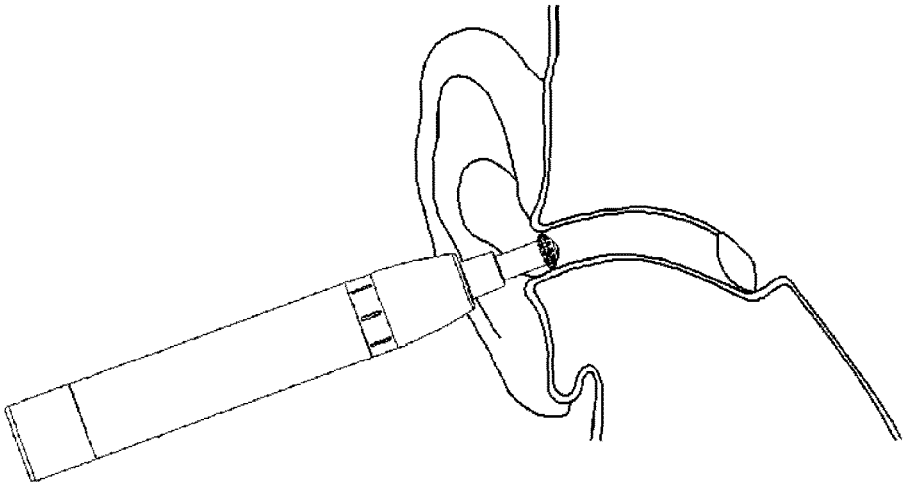
FIGS. 3 and 4 represent the possible uses of the NEC according to the invention for the ears and the nose. The NEC according to the invention shaves in the penetration direction as well as in the withdrawal hole direction.
Figure 4:
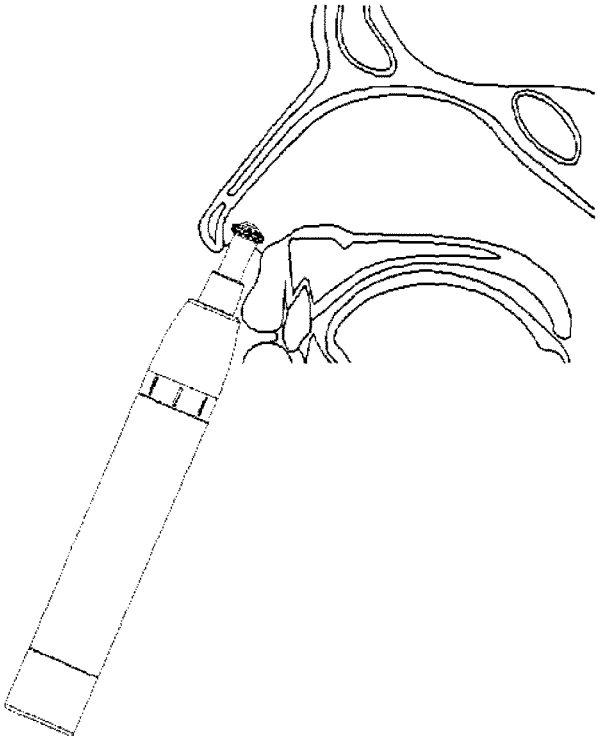
Figure 5:
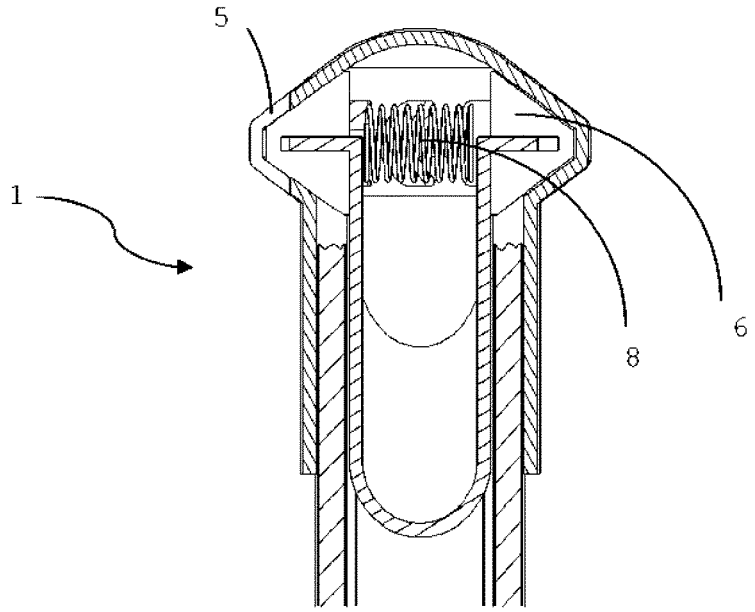
FIG. 5 shows a cross section of a NEC head operating mode according to the invention.
Figure 6:
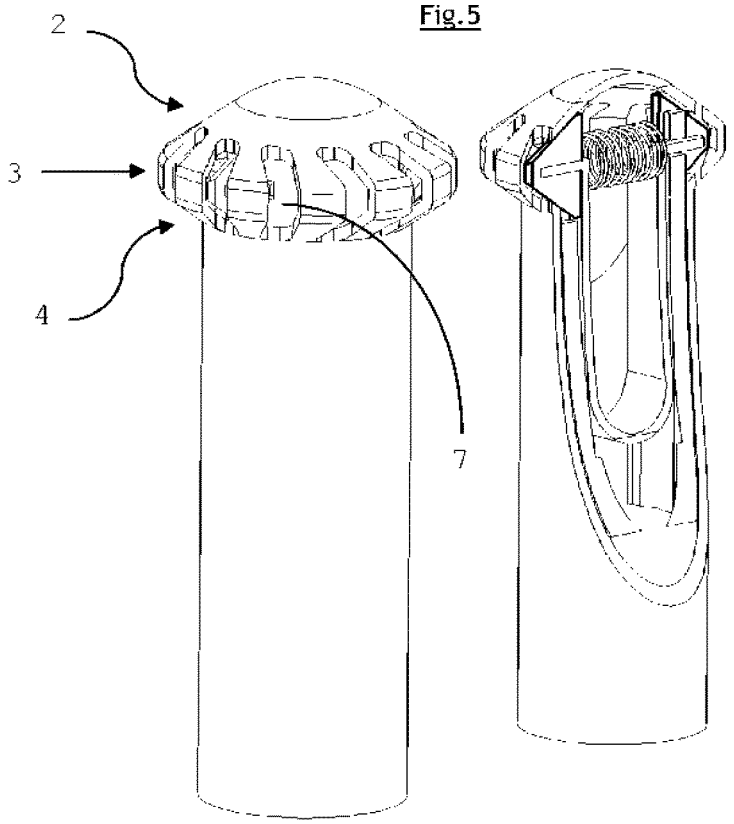
FIG. 6 represents a view in three dimensions with a partial section showing the layout of the elements inside the head and the penetration slots both on the front, side and rear sides of the head in the penetration direction. In this operation method, the head generally takes a form of a truncated dual cone.
Figure 7:
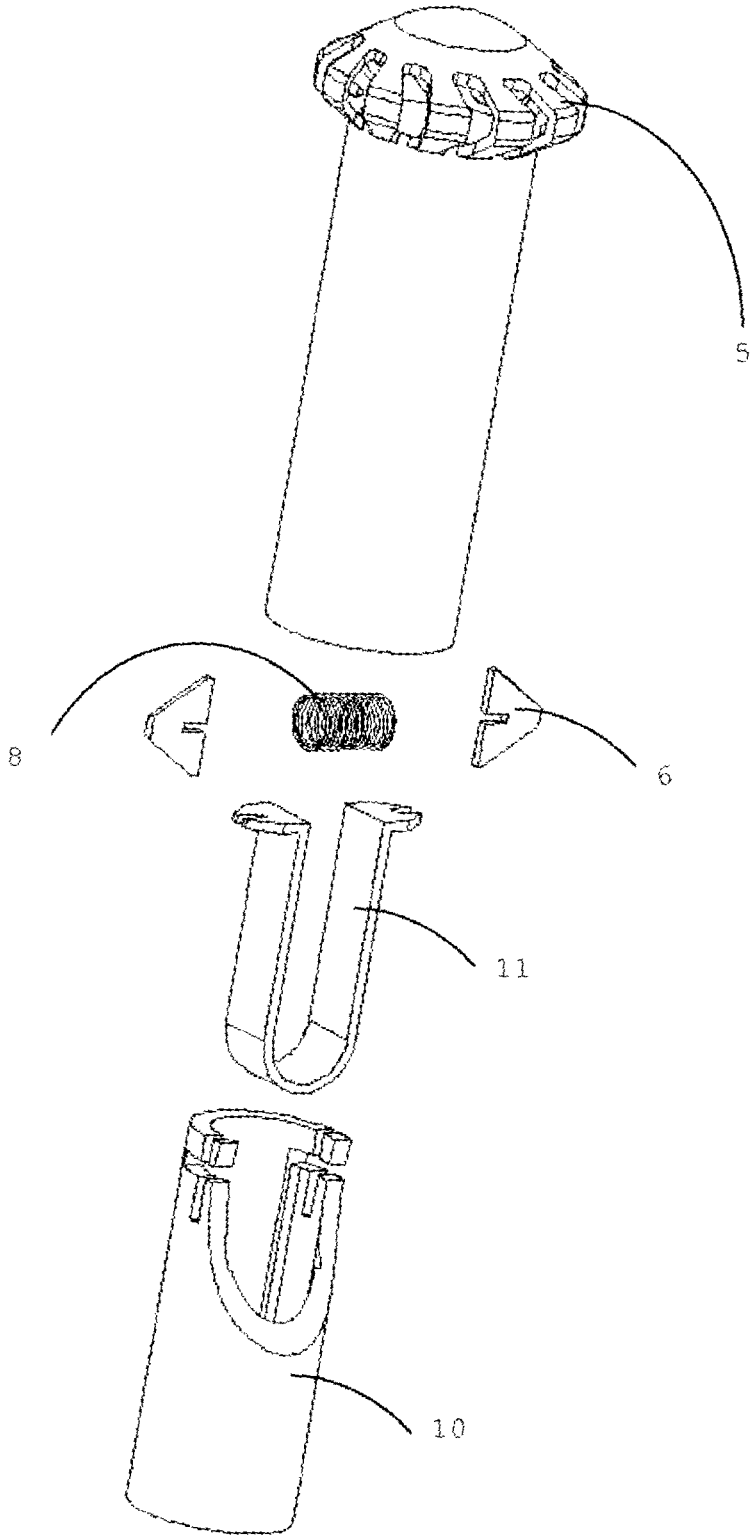
FIG. 7 shows an exploded view of the invention NEC head operating mode with its constituent elements. The spring pushes the blades against the front and rear faces of the stationary blade.
Figure 8:
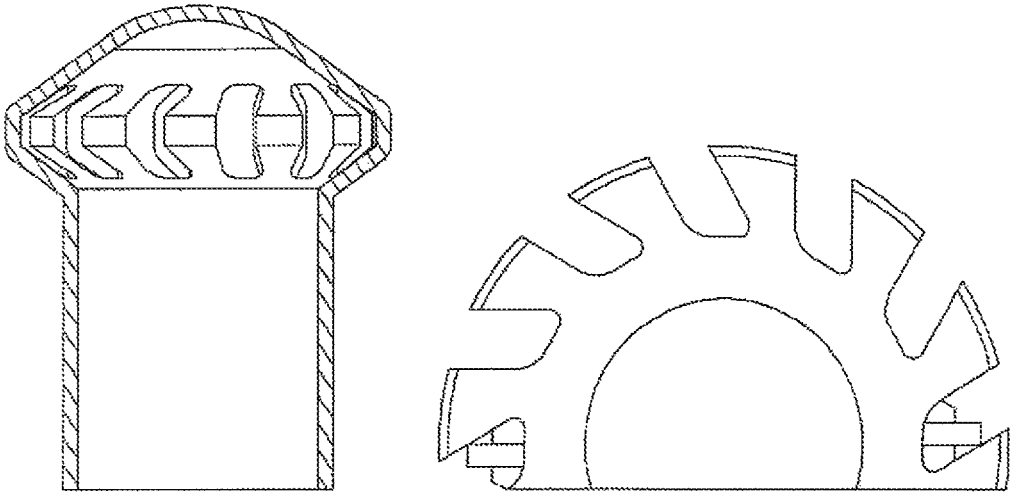
FIG. 8 shows front and plan views of the NEC stationary blade according to the invention.
Figure 9:
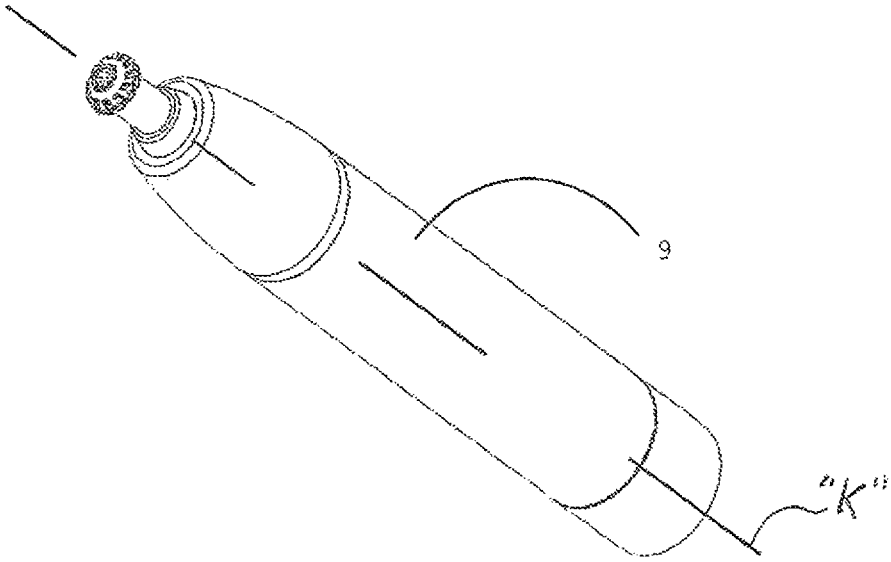
FIG. 9 shows a 3D overview of a NEC operating mode according to this invention with its handle which incorporates a motor and a rechargeable battery or a battery. The handle may define a central longitudinal axis "k" and can take different forms, and its form is only limited by practical gripping considerations.

1. NEC shaving head
2. NEC head front face (front part of the head)
3. NEC head side face
4. NEC head rear face
5. Stationary blade
6. Mobile blade
7. Hair penetration slots
8. Spring
9. Handle
10. Drive cylinder
11. Mobile blade support device
12. Opening on the stationary blade
13. Opening on the drive cylinder

DETAILED DESCRIPTION OF THE INVENTION

The origin of this invention lies in the observation that state of the art nose and ear clippers (NEC) shave the nose and ear hairs in the direction of the penetration of the shaving head in the ports concerned. This is simply due to the lack of slots for the penetration of the hair in the stationary blade on all sides of the head. On the state of the art NEC heads, the penetration slots are generally located on the front side, i.e. the front face of the head in the direction of the penetration into the cavity to be shaved, the slots usually overflow a bit on the side faces as shown in FIG. 1.

To increase the shaving efficiency, this invention offers a NEC with a shaving head with slots for the penetration of the hair on the set of faces of the stationary blade, so also on the back side which allows to considerably increase the shaving efficiency and to limit the number of back and forth movements for the same result.

Figure 10:
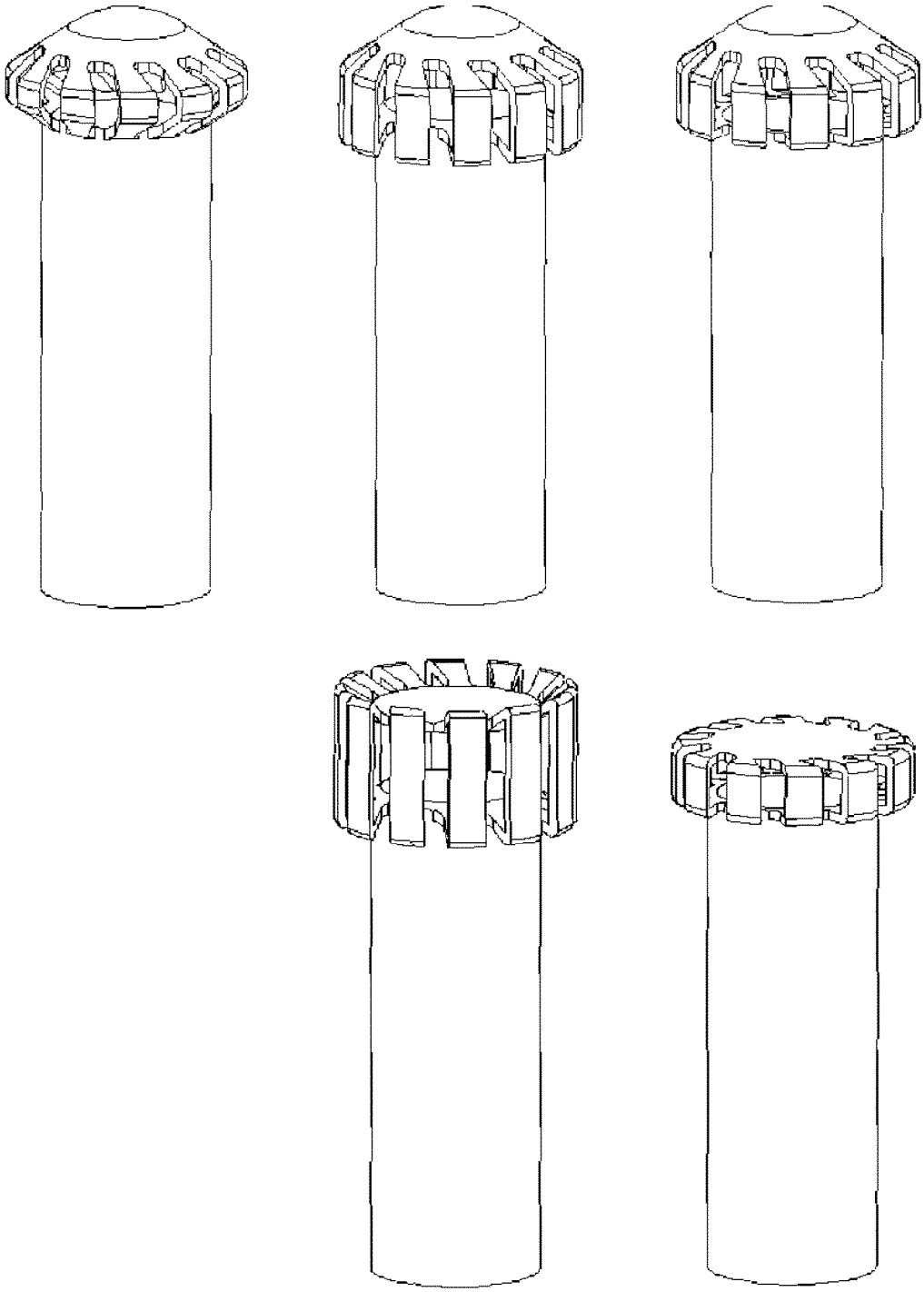
FIG. 10 represents an open-ended set of NEC shaving heads according to this invention. All these heads have the feature where the stationary blade not only has front and side penetration slots on the parts but also on the back of the head in the penetration direction into the hole to be shaved.
Figure 11:
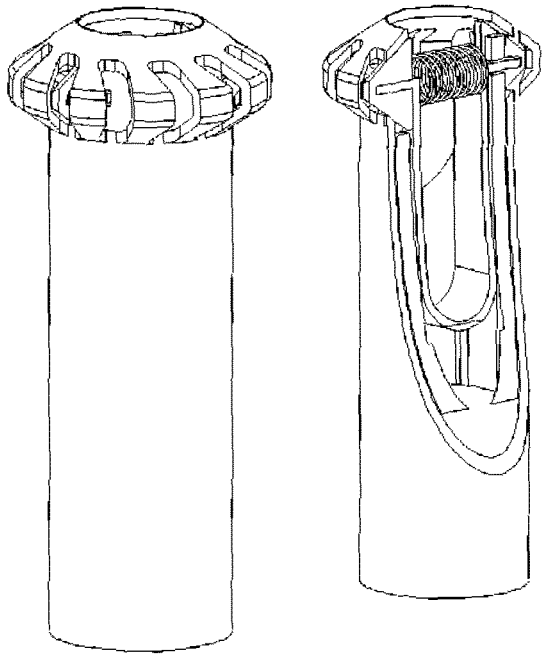
FIG. 11 shows another operating mode according to the invention with an opening in the center of the stationary blade facilitating rinsing with water.
Figure 12:
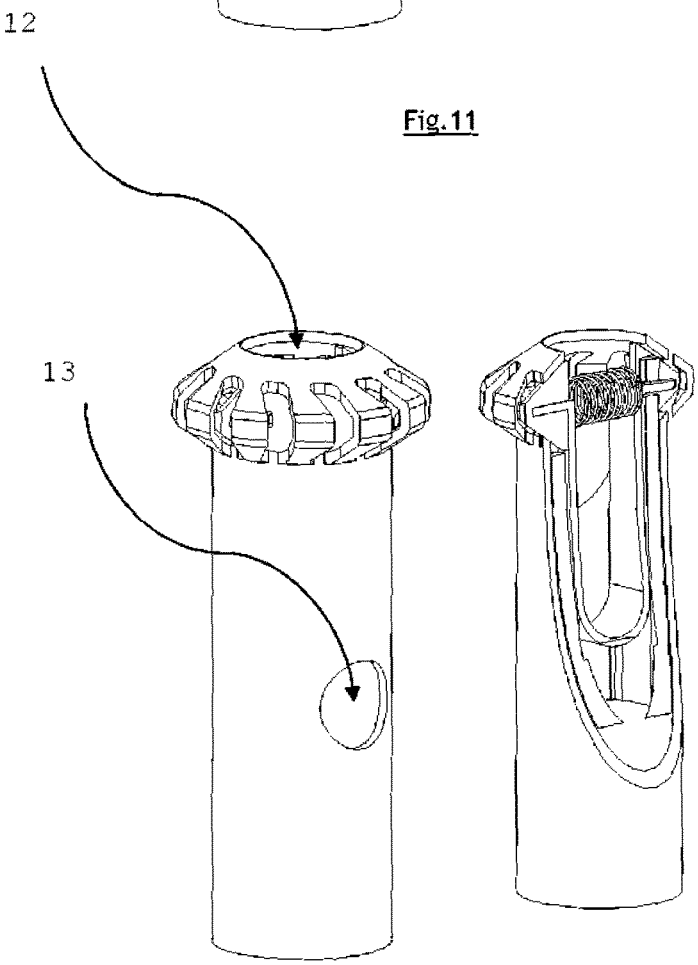
FIG. 12 has the same operating mode as that of FIG. 11, but with an additional opening on the mobile knife drive cylinder allowing the passage of the rinsing water.

FIG. 10 represents an open-ended set of NEC shaving heads according to the main characteristics of this invention. The presence of slots for the penetration of the hair on a large part of the front, side and rear also increases the accessibility of the rinse water to the moving blade to clean the head.

Preferably, the mobile blades 5 hair penetration slots 7 extends uninterrupted between the front 2 and rear 4 faces passing through the side face 3. The slots are therefore not interrupted by a potential gap between the face 2, side 3 and back 4 slots allowing them to function as a comb which is the desired effect.

To further improve head cleaning ease, we can provide an opening 12 on the stationary blade 5 central part dome and even associate it with an additional opening on the drive cylinder 13 to ensure a water flow through the device when rinsing.

The mobile blades 6 are pushed by a single spring 8 against the inner wall of the stationary blade 5, when it has a dual cone shape. The state of the art stationary blades usually need two springs, one spring to push in the direction of the rotation axis direction, and another for the thrust in the direction perpendicular to the rotation axis.

To avoid that the mobile blades enter the slots for the stationary blade 5 hair penetration, they make a cutting angle with the radial direction of the shaving head; to improve the cut, they also form an angle with said shaving head rotation axis.

The device according to the invention can be equipped with one or several luminescent electrodes to illuminate the holes to be shaved.

The invention claimed is:

1. A motorized clipper for trimming hairs which grow in the nose and ear cavities of users, which comprises:

a handle defining a central longitudinal axis; and a shaving head mounted to said handle and configured for insertion within a nose or an ear cavity of a user, said shaving head including a pair of moving blades and a stationary blade, said stationary blade having slots for the penetration of the hairs on a front face and on a side face thereof as viewed in a direction of introduction of said shaver head into a cavity to be trimmed, said stationary blade also includes slots for the penetration of hairs on a rear face thereof also allowing cutting of hairs upon a withdrawal of said shaving head from the cavity to be trimmed, wherein said side face defines a cylindrical wall having a constant diameter extending along said central longitudinal axis; and wherein said front face and wherein said rear face each contiguously extend from said cylindrical wall of said side face and taper radially inwardly relative to said central longitudinal axis.

2. The clipper according to claim 1, wherein said shaving head includes a single spring configured to bias said moving blades against said front and rear faces of said stationary blade.

3. The clipper according to claim 1, wherein said stationary blade defines a central opening aligned with said central longitudinal axis and spaced from said slots for passage of rinsing fluid.

4. The clipper according to claim 1, wherein a driving cylinder coupled to said shaving head has an opening on its side face.

5. The clipper according to claim 1, wherein said slots for the penetration of hair in said stationary blade form a cutting angle in a radial direction and with respect to a rotation axis of the said shaving head.

6. The clipper according to claim 1, wherein said slots for penetration of hair in said stationary blade extend uninterrupted between said front and rear faces through said side face.

7. The clipper according to claim 1 wherein said handle defines an opening therethrough for passage of rinsing fluids.

8. The clipper according to claim 1 wherein said moving blades are disposed in diametrical opposed relation, each said moving blade defining:

an outermost linear edge, said outermost linear edge disposed within said cylindrical wall of said side face of said shaving head and being configured to trim hair received through said slots and adjacent said side face;

a front tapered edge extending from said outermost linear edge and disposed within said front face, said front tapered edge configured to trim hair received through said slots and adjacent said front face; and a rear tapered edge extending from said outermost linear edge and disposed within said rear face, said rear tapered edge configured to trim hair received through said slots and adjacent said rear face.

9. The clipper according to claim 8 wherein said front face and said rear face each define a linear taper, and said front and rear tapered edges of said moving blades each define a linear taper.

10. A motorized clipper for trimming hairs which grow in the nose or ear cavities of a user, which comprises:

a handle defining a central longitudinal axis; and a trimming head mounted to said handle and configured for insertion within a nose cavity and an ear cavity of a user, said trimming head including an outer stationary blade and an inner moving blade disposed within said stationary blade, said stationary blade including a leading front face, a trailing rear face and a medial side face disposed between said leading front face and said trailing rear face and contiguous therewith, said medial side face defining a cylindrical wall having a constant diameter extending along said central longitudinal axis, said leading front face and said trailing rear face tapering radially inwardly from said cylindrical wall of said medial side face, said stationary blade having slots for penetration of hair, said slots extending continuously from said leading front face through said medial side face and into said trailing rear face.

11. The clipper according to claim 10 wherein said handle defines an opening therethrough for passage of rinsing fluids.

12. The clipper according to claim 10 wherein said stationary blade defines an opening in said front face in general longitudinal alignment with said central longitudinal axis and spaced from said slots for passage of rinsing fluids.

13. The clipper according to claim 10 wherein said moving blade defines an outermost linear edge, said outermost linear edge disposed within said cylindrical wall of said medial side face of said trimming head and being configured to trim hair received through said slots and adjacent said medial side face.

14. The clipper according to claim 13 wherein said moving blade includes:

a front tapered edge extending from said outermost linear edge and disposed within said leading front face, said front tapered edge configured to trim hair received through said slots and adjacent said leading front face; and a rear tapered edge extending from said outermost linear edge and disposed within said trailing rear face, said rear tapered edge configured to trim hair received through said slots and adjacent said trailing rear face.

15. The clipper according to claim 14 including first and second moving blades, said first and second moving blades being disposed in diametrical opposed relation, each said first and second moving blades including said outermost linear edge, said front tapered edge and said rear tapered edge.

16. The clipper according to claim 15 including a single spring disposed between said first and second moving blades, said single spring configured to bias said front tapered edges of said first and second moving blades against said leading front face of said stationary blade and configured to bias said rear tapered edges of said first and second moving blades against said trailing rear face of said stationary blade.

17. The clipper according to claim 16 including a drive member coupled to said first and second blades.

18. The clipper according to claim 10 wherein said leading front face and said trailing rear face are contiguous with said cylindrical wall of said medial side face.

* * * * *